US005873134A

United States Patent [19]

Chou

[11] Patent Number: 5,873,134

[45] Date of Patent: Feb. 23, 1999

[54] SWIMMING GOGGLES WITH IMPROVED IMPERMEABILITY BETWEEN PROTECTIVE PADS AND LENSES

[76] Inventor: Terry Chou, No. 12, Hsin Ho Herng Road, Tainan City, Taiwan

[21] Appl. No.: 6,502

[22] Filed: Jan. 14, 1998

[51] Int. Cl.[6] ..... A61F 9/02

[52] U.S. Cl. ..... 2/452; 2/439

[58] Field of Search ..... 2/428, 445, 452, 2/448, 430, 440, 441, 442, 443, 444, 446, 439; 351/43

[56] References Cited

U.S. PATENT DOCUMENTS

| | | | |
|---|---|---|---|
| 4,564,960 | 1/1986 | Nishyama | 2/452 |
| 5,408,702 | 4/1995 | Chiang | 2/452 |
| 5,524,300 | 6/1996 | Chiang | 2/439 |
| 5,706,526 | 1/1998 | Huang | 2/452 |
| 5,734,995 | 4/1998 | Chiang | 2/452 |

*Primary Examiner*—Michael A. Neas
*Assistant Examiner*—Larry D. Worrell, Jr.
*Attorney, Agent, or Firm*—Rosenberg, Klein & Bilker

[57] ABSTRACT

A pair of swimming goggles includes a pair of protective pads each including an engaging section having an engaging groove defined therein. Each protective pad further includes an outer side having a mediate portion. A pair of lenses each has a flange securely received in the engaging groove of an associated protective pad. A pair of connecting straps each has a connecting section connected to the outer side of the engaging section of the associated protective pad. A slot is defined in the connecting section such that the mediate portion of the outer side of the engaging section is not deformed when the strap is subjected to a force.

2 Claims, 6 Drawing Sheets

SWIMMING GOGGLES WITH IMPROVED IMPERMEABILITY BETWEEN PROTECTIVE PADS AND LENSES

BACKGROUND OF THE INVENTION

The present invention relates to a pair of swimming goggles with improved impermeability between the protective pads and the lenses thereof.

FIG. 5 illustrates a pair of conventional swimming goggles which includes two lenses 51 formed of transparent rigid material, two protective pads 52 made of plastic material, a bridge member 53, and a connecting strap 54. Each lens 51 includes a flange 511 formed on an outer periphery thereof. In addition, each lens 51 includes a first engaging slot 513 defined in an outer side thereof around which an end of the connecting strap 54 is wound. Each lens 51 further includes a second slot 512 defined in an inner side thereof for releasable engagement with the bridge member 53. Each pad 52 includes an engaging section 521 having an engaging groove 522 for receiving the flange 511 of the associated lens 51. Each pad 52 further includes a flange 523 formed on an interior side thereof to provide a close contact with the user's eye socket. The connecting strap 54 includes two buckles 55 provided on two ends thereof to allow adjustment of the length thereof. However, the buckles 55 may bear against the skins adjacent to the user's ears and thus cause an uncomfortable feeling. In addition, impermeability between the pair of swimming goggles and the user's eyes are adversely affected.

A proposal to solve the above-mentioned problem is illustrated in FIGS. 6 and 7 of the drawings in which the engaging section 611 of each of the protective pads 61 is integrally formed with a connecting strap 62 at a connecting area "a", while the buckle (not shown) is provided on the distal end of each of the connecting straps 62. The protective pads 61 and the connecting straps 62 are both formed of plastic material. As shown in FIG. 7, each engaging section 611 includes an engaging groove 612 for receiving a flange 631 of an associated lens 63. However, when the connecting strap 62 is pulled rearwardly (see the arrow in FIG. 7), leakage still may occur between the flange 631 of the lens 63 and the engaging groove 612 of the protective pad 61 as the pulling force can be transmitted to the engaging section 611 and thus cause deformation (see the phantom lines). The present invention is intended to provide an improved goggle structure which mitigates and/or obviates the above problems.

SUMMARY OF THE INVENTION

In accordance with the present invention, a pair of swimming goggles comprises a pair of protective pads each including an engaging section having an engaging groove defined therein. Each protective pad further includes an outer side having a mediate portion. A pair of lenses each has a flange securely received in the engaging groove of an associated protective pad. A pair of connecting straps each has a connecting section connected to the outer side of the engaging section of the associated protective pad. A slot is defined in the connecting section such that the mediate portion of the outer side of the engaging section is not deformed when the strap is subjected to a force. Accordingly, disengagement of the flange of the lens from the engaging groove of the protective pad is prevented to thereby provide an improved impermeability therebetween.

The pair of swimming goggles may further comprise a bridge member integrally formed between the protective pads.

Other objects, advantages, and novel features of the invention will become more apparent from the following detailed description when taken in conjunction with the accompanying drawings.

DESCRIPTION OF THE PREFERRED EMBODIMENT

Figure 1:
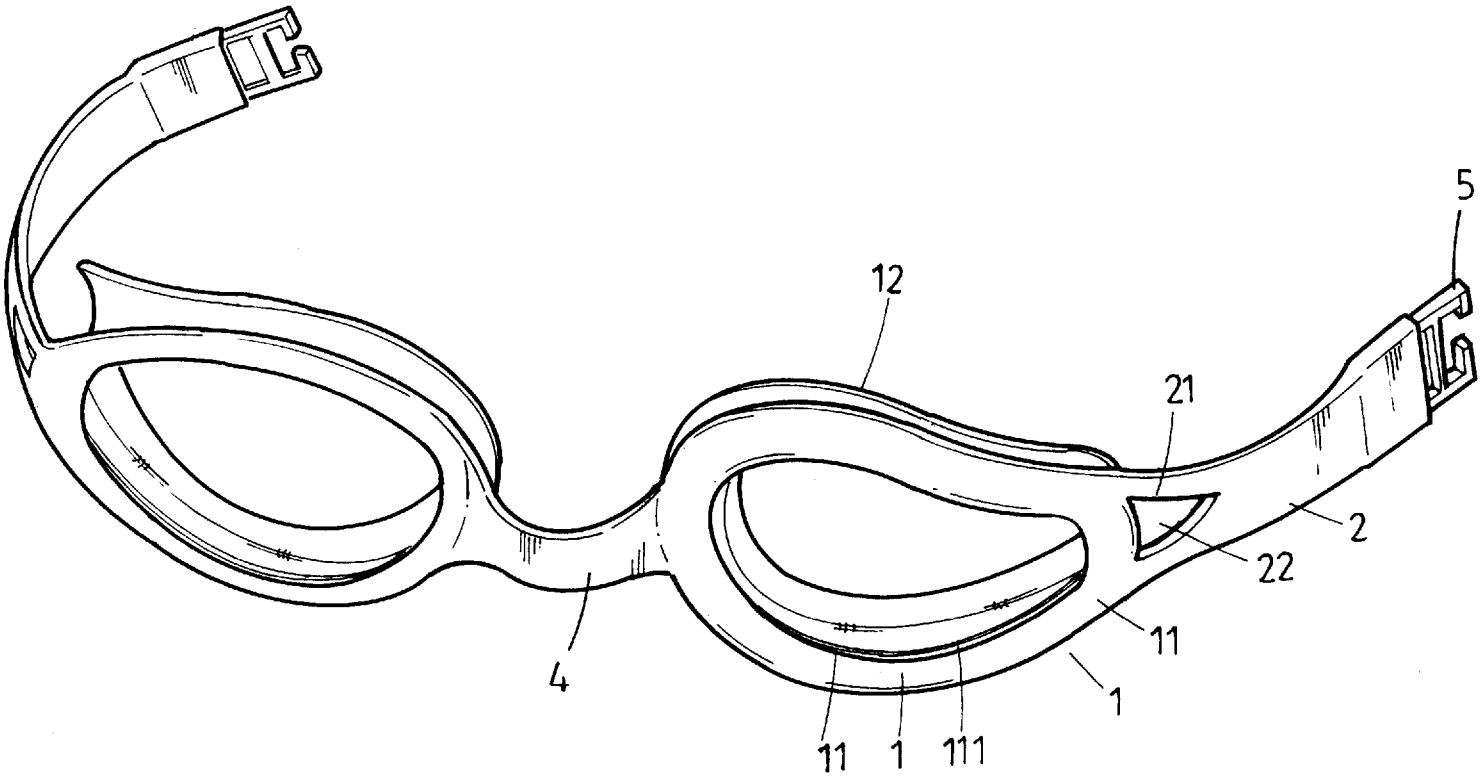
FIG. 1 is a perspective view of a pair of swimming goggles in accordance with the present invention in which the lenses are omitted for clarity.
Figure 2:
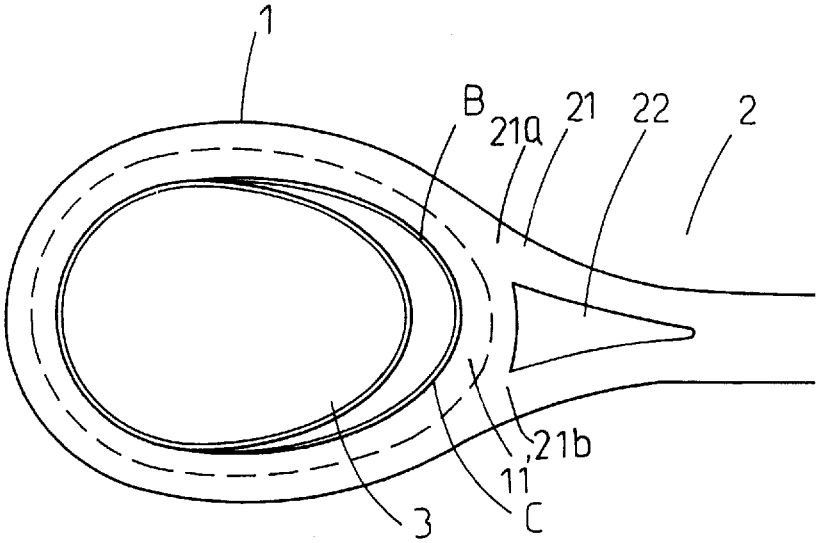
FIG. 2 is a front elevational view of a portion of the pair of swimming goggles in accordance with the present invention.
Figure 3:
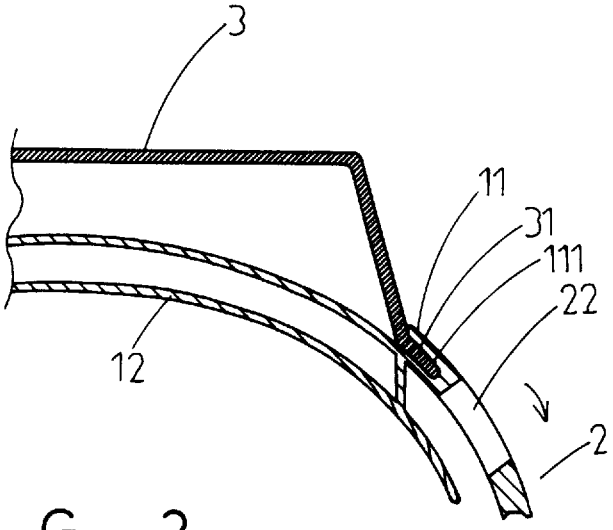
FIG. 3 is a partial sectional view of the pair of swimming goggles in accordance with the present invention.

Referring to FIGS. 1 to 4 and initially to FIG. 1 to 3, a pair of swimming goggles in accordance with the present invention comprises a pair of protective pads 1, a pair of lenses 3 (FIGS. 2 and 3) respectively received in the protective pads 1, and two connecting straps 2. Each protective pad 1 includes an engaging section 11 having an engaging groove 111 defined therein for securely receiving a flange 31 (FIG. 3) formed on an outer periphery of an associated lens 3. Each protective pad 1 further includes a contact flange 12 formed on an interior side thereof to provide a close contact with the user's eye socket.

Figure 4:
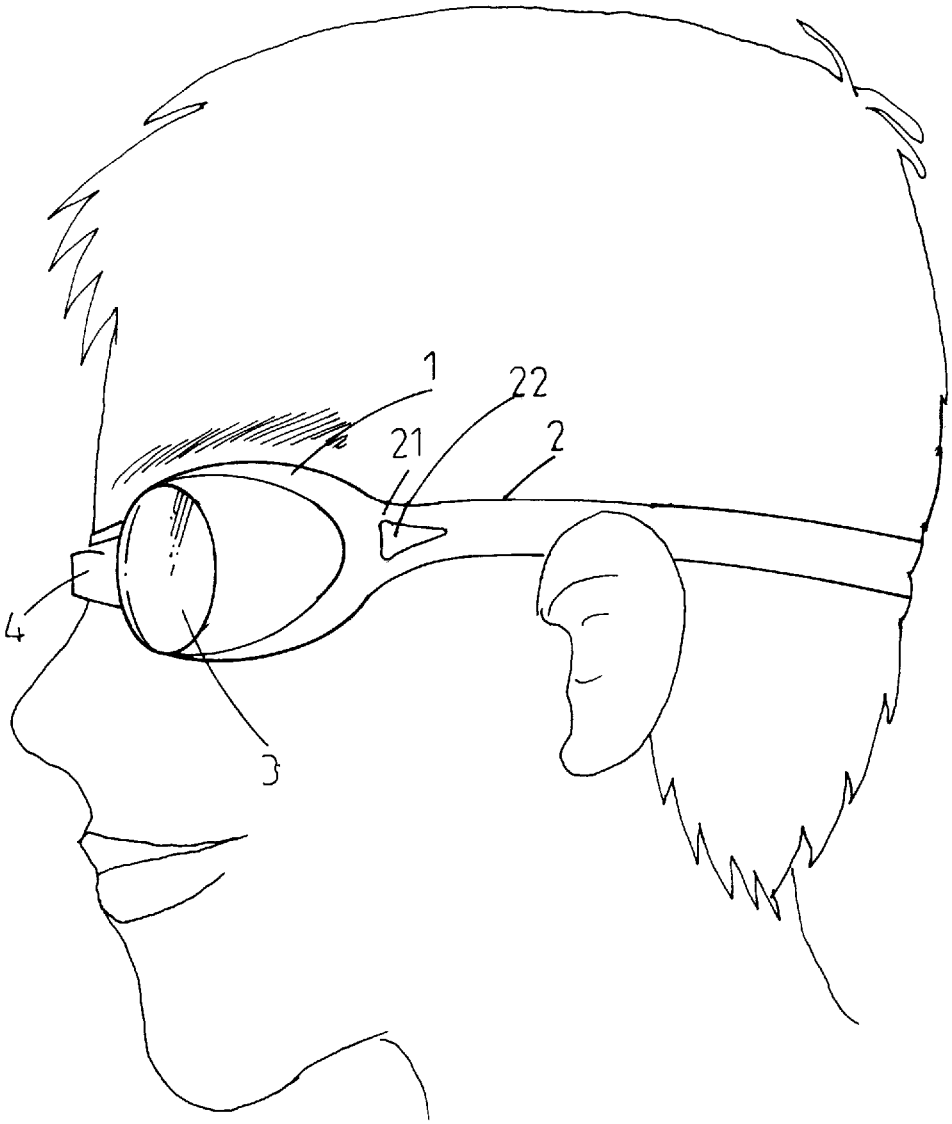
FIG. 4 is a schematic view illustrating use of the pair of swimming goggles in accordance with the present invention.
Figure 5:
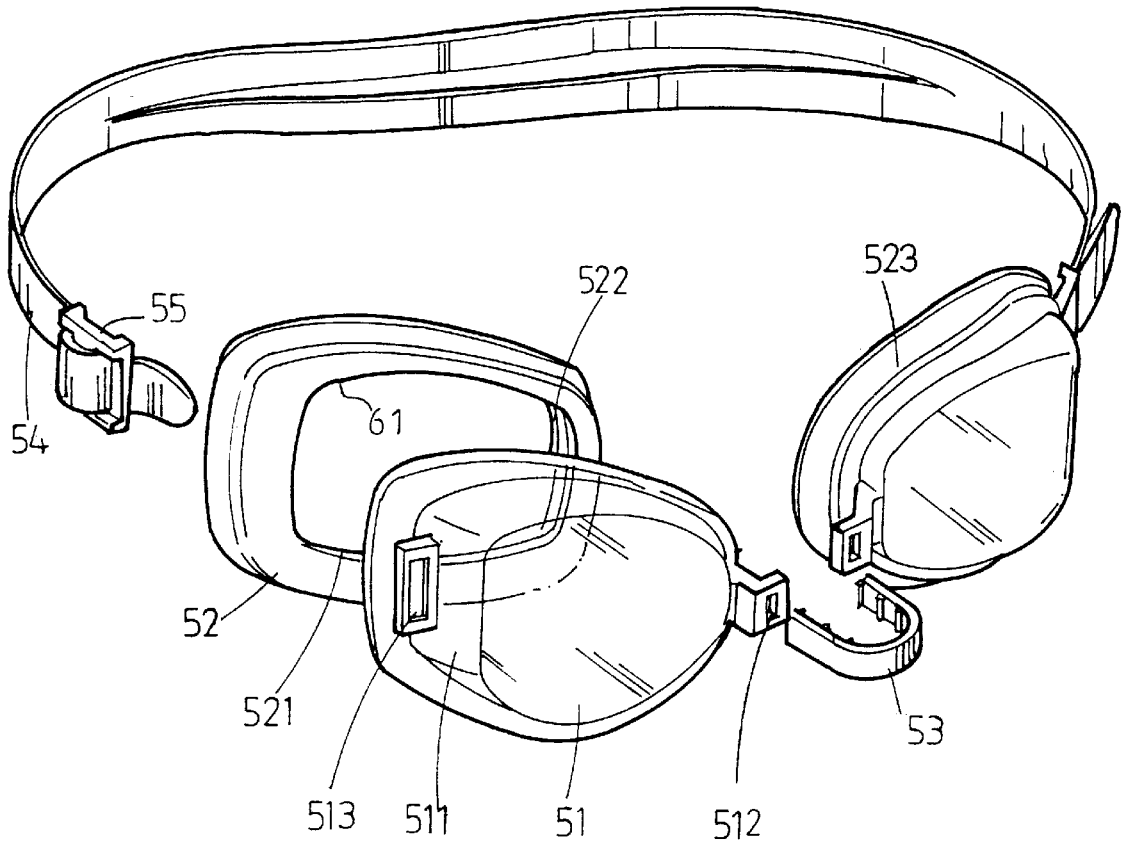
F I G. 5 PRIOR ART
FIG. 5 is a perspective view, partially exploded, illustrating a pair of prior art swimming goggles.
Figure 6:
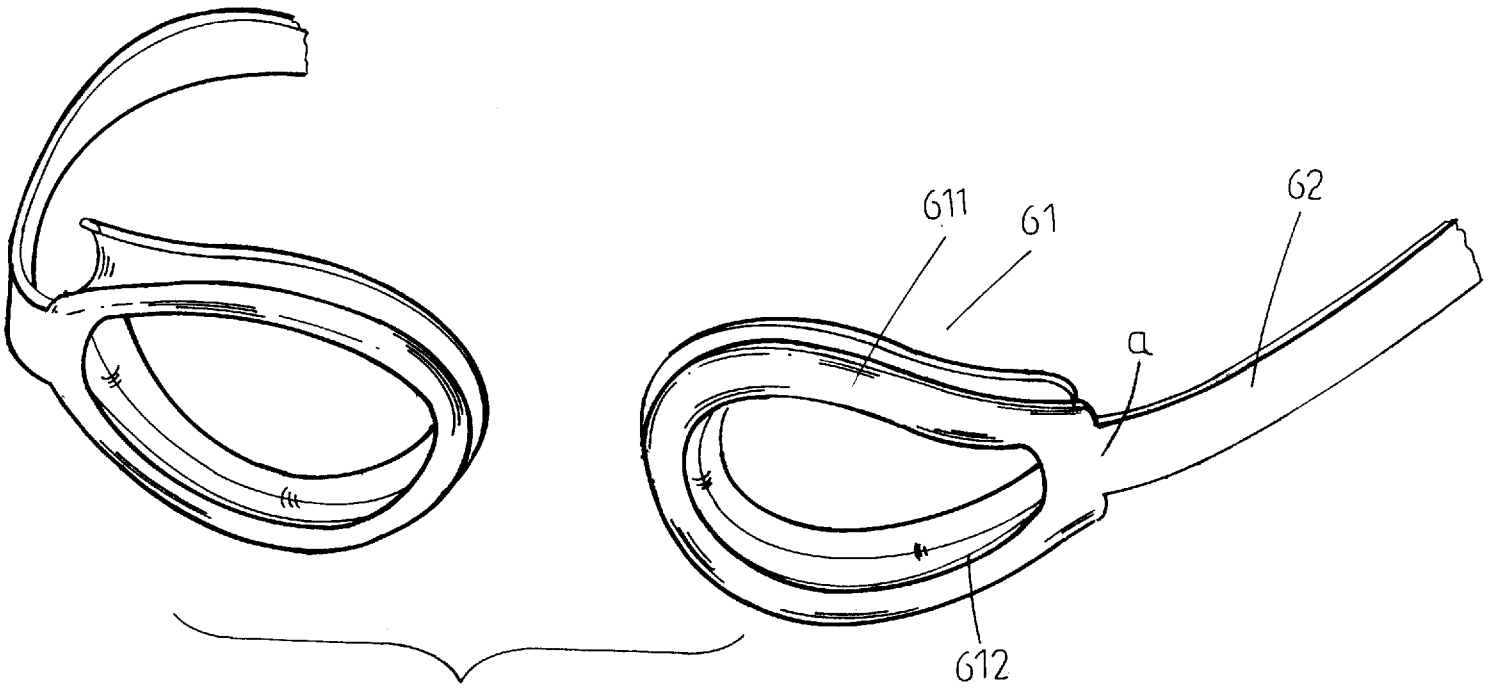
FIG. 6 PRIOR ART
FIG. 6 is an exploded perspective view illustrating a portion of another pair of prior art swimming goggles.
Figure 7:
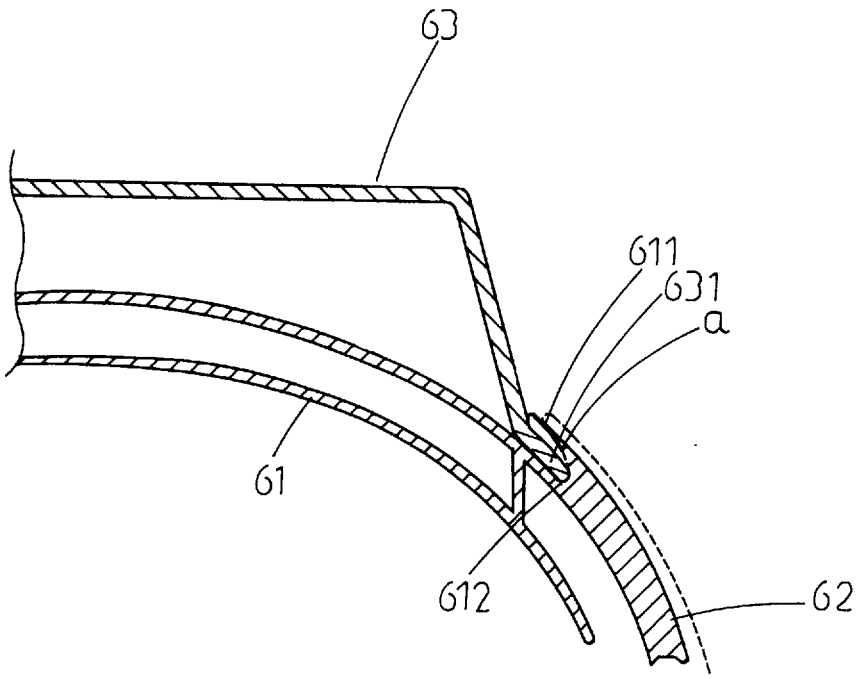
FIG. 7 PRIOR ART
FIG. 7 is a partial sectional view of the pair of swimming goggles in FIG. 6.

Each connecting strap 2 includes a connecting section 21 for connection with an outer side of the engaging section 11 of the associated protective pad 1, and a slot 22 is defined in the connecting section 21. Preferably, the protective pad 1 and the strap 2 are integrally formed. The protective pads 1 may be interconnected by a bridge member 4 which can be integrally formed with the protective pads 1. In addition, a buckle 5 may be provided on a distal end of each strap 2 to allow adjustment of the total length of the straps 2, which is conventional and therefore not further described. It is appreciated that, as shown in FIG. 2, the connecting section 21 connects with the outer side of the engaging section 11 at two connecting areas 21*a* and 21*b* which respectively have two corresponding points "B" and "C" on the engaging groove 111. These points "B" and "C" represent different angles with respect to a pulling force applied to the strap 2. Thus, when the strap 2 is subjected to a rearward pulling force, since a mediate portion of a connecting section 11' (FIG. 2) in the outer side of the engaging section 11 is not deformed, disengagement of the flange 31 of the lens 3 from the engaging groove 111 of the protective pad 1 is prevented to thereby provide an improved impermeability therebetween. Thus, the pair of swimming goggles in accordance with the present invention provides improved impermeability and improved comfort to the user (FIG. 4).

Although the invention has been explained in relation to its preferred embodiment, it is to be understood that many other possible modifications and variations can be made without departing from the spirit and scope of the invention as hereinafter claimed.

What is claimed is:

1. A pair of swimming goggles, comprising:

a pair of substantially identical protective pads, each said protective pad including an engaging section having an engaging groove defined therein, each said protective pad further including an outer side having an upper portion, a lower portion and a mediate portion therebetween;

a pair of substantially identical lenses, each said lens having a flange securely received by said engaging groove of a respective one of said protective pads; and, a pair of connecting straps for securing the swimming goggles to the user thereof, each said connecting strap having an upper connecting segment, a lower connecting segment, and a through-slot formed therebetween, said upper and lower connecting segments respectively engaging said upper and lower portions of said outer side of a respective one of said protective pads, thereby substantially eliminating deformation of said mediate portion when said connecting strap associated therewith is subjected to a pulling force.

2. The pair of goggles according to claim 1, further comprising a bridge member integrally formed between the protective pads.

* * * * *